United States Patent [19]

Ikeda

[11] 4,185,452

[45] Jan. 29, 1980

[54] DIGITAL TIME DISPLAY SYSTEM

[76] Inventor: Arihiko Ikeda, 5-1, Komakado, Gotemba-shi, Sizuoka-ken, Japan, 412

[21] Appl. No.: 904,642

[22] Filed: May 10, 1978

Related U.S. Application Data

[63] Continuation of Ser. No. 703,336, Jul. 8, 1976, abandoned.

[51] Int. Cl.[2] ..... G04C 3/00; G04F 10/04

[52] U.S. Cl. ..... 58/23 R; 58/39.5; 235/92 T; 324/186

[58] Field of Search ..... 58/57, 21.13, 23 R, 58/39.5, 145 K, 146, 147, 152; 324/186, 187, 189; 235/92 T; 328/41

[56] References Cited

U.S. PATENT DOCUMENTS

| | | | |
|---|---|---|---|
| 2,105,470 | 1/1938 | Bower | 58/39.5 |
| 3,284,715 | 11/1966 | Kaminsky | 58/23 R |
| 3,306,030 | 2/1967 | Wiley | 58/145 R |
| 3,854,277 | 12/1977 | Samejima et al. | 58/39.5 |
| 3,854,281 | 12/1974 | Reichert | 324/189 |
| 3,965,669 | 6/1976 | Larson et al. | 58/39.5 |

FOREIGN PATENT DOCUMENTS

| | | | |
|---|---|---|---|
| 990038 | 7/1949 | France | 58/127 |

*Primary Examiner*—Edith S. Jackmon

[57] ABSTRACT

A digital time display system in which one hour is represented by 10,000 times a time interval which is equal to 0.36 second in the currently prevailing clock time display system which is based on the scale of 60. Each time interval is effective to step a numeral on the clock time display.

2 Claims, 3 Drawing Figures

DIGITAL TIME DISPLAY SYSTEM

This is a continuation of application Ser. No. 703,336, filed July 8, 1976 which is now abandoned.

FIELD AND BACKGROUND OF THE INVENTION

The invention relates to a system for displaying the time of day, and more particularly, to a digital time display system which operates on the decimal system.

The current clock time display system originates from the concept of dividing the period from the sunrise to the sunset into twelve equal intervals, which was established about 50th century B.C. In 17th century A.D., the original concept has been developed to dividing the period of a day into 24 equal intervals regardless of the sunrise or sunset, and one hour thus established has been divided into 6 equal intervals initially, and then into 12 equal intervals. With improvements in the accuracy of clocks, the division of one hour into 60 equal intervals has been established about the middle of 19th century A.D. and maintained until the present time. However, it is understood that the division of one hour into 60 minutes involves a difficulty of conversion. By way of example, a time period of 248 minutes must be converted into the scale of 60 to find the proper designation of four hours and eight minutes, rather than allowing the direct punctuation into two hours and forty-eight minutes which would be the case if the hour were represented in terms of the decimal system. This causes a vast amount of labor and time to be consumed in converting the cumulative labor time in factory or cumulative time in an automobile race, for example, into the more common hour and minute designation.

On the other hand, it is noted that a usual digital clock time display affords a sufficient time to recognize the display of "second" inasmuch as it steps every second. However, it is very difficult, if not impossible, to visually discriminate a fraction of one second in such display system when the increment is in unit of one-tenth of a second. Thus it will be appreciated that there is a need in the art for an improvement in the stepping rate for the least significant digit of such display system.

SUMMARY OF THE INVENTION

Therefore, it is a general object of the invention to provide a digital time display system which operates on the decimal system for ease of conversion.

It is a more specific object of the invention to provide a digital time display system having a stepping rate for the least significant digit which is visually distinguishable and selected to be a proper value.

According to the invention, there is provided a novel digital time display system in which the time length of one hour remains unchanged while it is divided into 100 "new minutes", one of which is in turn divided into 100 "new seconds", thus using one "new second" to step the least significant digit. In other words, the present system has the least significant digit which is stepped every 0.36 second or 1/10,000 of one hour. This stepping rate is higher than that for one second in the currently prevailing system and is lower than that for one-tenth of a second, and is found to be most suitable as considered from the standpoint of the threshold for a time interval during which a time increment is to be visually recognized.

Thus, one "new second" equals 0.36 second, and since 100 "new seconds" equal one "new minute" it will be seen, therefore, that one "new minute" equals 36 seconds ($100 \times 0.36 = 36$ seconds) and 36 seconds equals 0.6 minutes ($36/60 = 0.6$).

DESCRIPTION OF A PREFERRED EMBODIMENT

Figure 1:
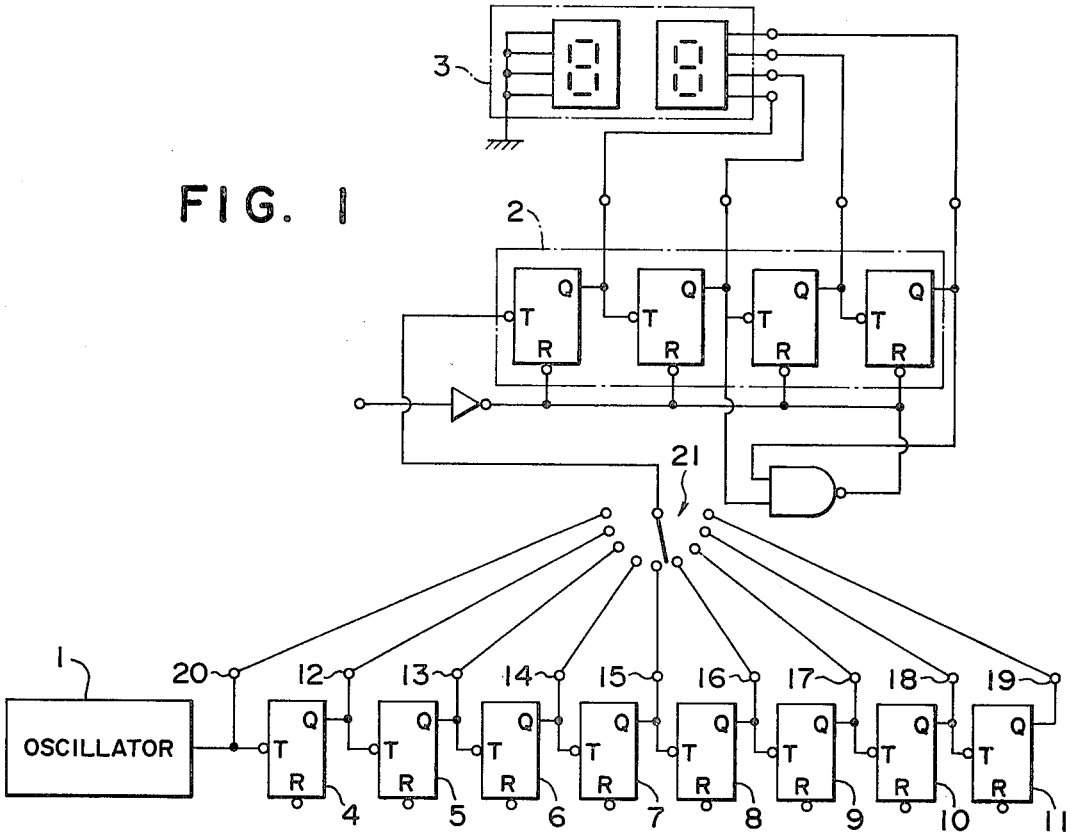
FIG. 1 is a circuit diagram of an apparatus which is used in an experiment to determine the stepping rate in the time display system according to the invention.
Figure 2:
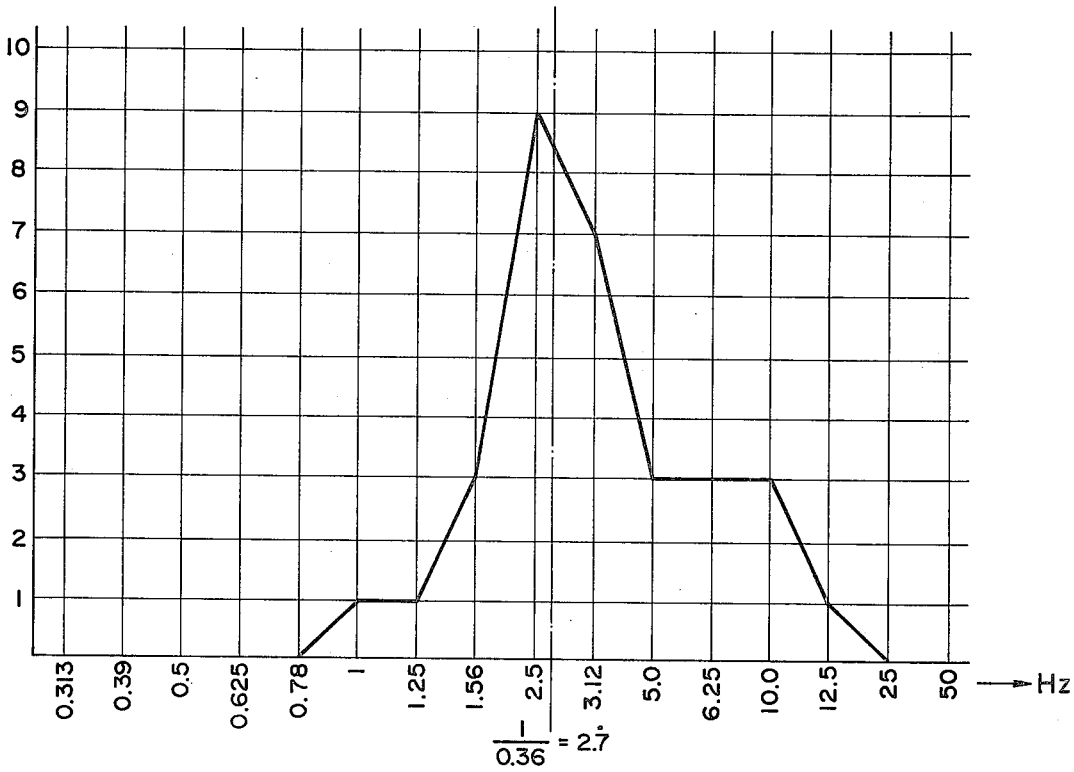
FIG. 2 graphically shows the optimum stepping frequency which is determined by an experiment using the apparatus shown in FIG. 1.

Before proceeding to the description of an embodiment of the invention, it may be useful to consider the significance of the stepping rate for the least significant digit in the digital time display system of the invention. FIG. 1 shows an experimental apparatus which has been constructed by the inventor for the purpose of determining a preferred stepping rate in the digital display system. The apparatus shown includes an oscillator 1 which feeds a counter 2 comprising four master-slave J-K flipflops of a known form. The counter 2 in turn feeds a luminescent diode 3 which is adapted to display numerals in seven segments. The apparatus can be said similar to a conventional digital numerical display, except that the standard frequency which is input to the counter 2 is made selectively variable by providing a plurality of frequency divider stages 4 to 11 having their output terminals 12 to 19 connected with respective stationary contacts of a switch 21. An output terminal 20 of the oscillator 1 is also connected with one of the switch contacts. The oscillator 1 runs continuously at a fixed frequency, and the oscillator output is sequentially fed to each of the frequency divider stages 4 to 11. Each of the stages 4 to 11 produces an output frequency which is equal to one-half its input frequency. Thus, if the oscillator 1 has an oscillation frequency of 50 Hz, for example, a corresponding output frequency appears on the terminal while successively lower sub-multiple frequencies of 25 Hz, 12.5 Hz, 6.25 Hz, 3.12 Hz, 1.56 Hz, 0.78 Hz, 0.39 Hz and 0.195 Hz appear on the terminals 12 to 19, respectively. The selection switch 21 selects one of these frequencies and feeds it to the counter 2. The counter 2 operates in a conventional manner to provide count signals, which are fed to the luminescent diode 3 to cause the display segments to be selectively illuminated. It is understood that the stepping rate of the digit is determined by an input frequency to the counter 2, and if the input frequency were 1 Hz, the stepping rate will be one per second. Thus, there is a one-to-one correspondence between the stepping rate of the least significant digit and the stepping frequency of the counter 2, the latter being chosen as representing the stepping rate in the description to follow.

An experiment has been conducted in which the recognizability of the digit displayed by the diode 3 as it steps has been determined by monitors when the output frequencies prevailing at the respective terminals 12 to 19 of the frequency divider stages 4 to 11 for oscillation frequencies of 50 Hz, 10 Hz, and 1 Hz of the oscillator 1 were individually applied to the counter 2. Of 27 frequencies in all, only 20 frequencies have been used, omitting extreme frequencies. The monitors were divided into three independent groups as indicated below.

| Group | Number of monitors | Sex | Average age | Date |
|---|---|---|---|---|
| 1 | 5 | male | 23.2 | April 30, 1976 |
| 2 | 5 | male | 38.6 | May 1, 1976 |
| 3 | 2 | female | 23.6 | May 1, 1976 |

Figure 3:
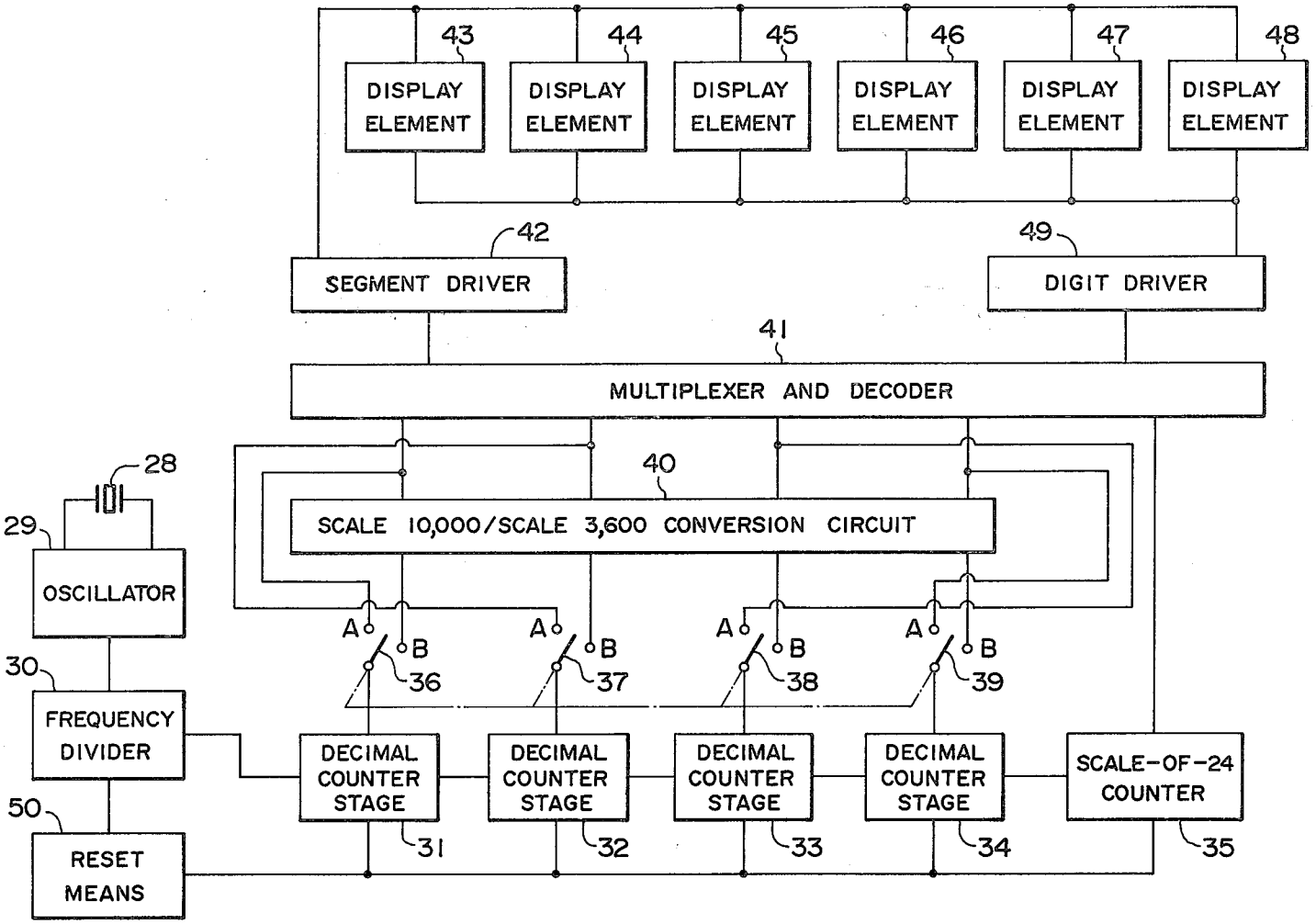
FIG. 3 is a block diagram of an embodiment of the time display system of the invention.

The inquiry was made if the stepping rate of the digit was felt too rapid, rapid, timely, slow, too slow. The answer was on the basis of one-out-of-five selection. In group 1, the maximum vote for the answer "timely" was obtained at the oscillation frequency of 2.5 and 3.12 Hz with an equal poll, and a similar result was obtained from group 2 even though there was one "timely" poll at the frequencies of 10 and 12.5 Hz when the majority found it to be too rapid. Group 3 answered that the frequency of 2.5 Hz was timely. When the frequency of 1 Hz was selected, there was only one "timely" poll, while the remainder answered either "slow" or "too slow". Of these, three monitors felt the rate irritatingly slow. FIG. 3 graphically shows the number of "timely" polls on the ordinate, as plotted against the frequency on the abscissa. From this result, it is concluded that the stepping rate of 2.7 Hz corresponding to a period of 0.36 second will be most suitable as the stepping rate for the least significant digit of a digital time display system.

Referring to FIG. 3, there is shown one embodiment of the digital time display system of the invention which operates on the basis of the scale of 100. The circuit arrangement of the system is generally similar to a conventional digital time display system which is constructed to operate on the basis of the scale of 60, but additionally includes a scale 10,000/scale 3,600 conversion circuit 40 which permits a display to be selectively used in either the scale of 100 or the scale of 60, and four ganged change-over switches 36, 37, 38 and 39.

A quartz oscillator 28 is connected with an oscillator circuit 29 which runs continuously at a fixed frequency. The oscillator 29 feeds a frequency divider 30 which is designed to produce an output frequency of 2.7 Hz corresponding to a period of 0.36 second. The divider 30 feeds a plurality of decimal counters 31, 32, 33 and 34 and a scale-of-24 counter 35 in turn. Each of the switches 26 to 39 has a contact A which is directly connected with a multiplexer-decoder circuit 41, and also has a contact B which is connected with the circuit 41 through the conversion circuit 40. Each switch has a movable contact which is connected with the output of a different one of the counter stages 31 to 34. The decoder 41 has its outputs input to a segments driver 42 which in turn has its various outputs connected with a clock time display unit comprising "hour" display elements 43, 44, "minute" display elements 45, 46 and "second" display elements 47, 48. These elements may comprise 7-segment luminescent diodes or 7-segment Nematic liquid crystal display elements. Alternatively, they may be constituted by an electronic display unit such as plasma display. A digit driver 49 supplies the drive voltage to the respective elements.

In the A-position of the ganged switches 36 to 39 which they assume normally, the time display is made on the scale-of-100 basis. When the switches are in their B-position, the scale-of-24 counter 35 continues to feed the multiplexer-decoder 41 directly, while the signals from the decimal counter stages 31 to 34 are passed through the conversion circuit 40 before being fed to the multiplexer-decoder 41, thereby producing a usual time display on the scale-of-60 basis. Reset means 50 is shown in FIG. 3 as serving resetting the frequency divider 30 and the counter stages 31 to 35.

Thus there is provided a digital time display system which operates on the basis of the scale of 100 so that an indication of "248 minutes" (new minutes) thereon is directly readable as 2 hours and 48 minutes (new minutes) and which incorporates a stepping rate easily recognizable by average user while retaining the majority of the conventional scale-of-60 circuit arrangement.

Having described the invention, what is claimed is:

1. A digital display system comprising a numerical display unit, and a circuit arrangement for producing outputs which drive the display unit, said numerical display unit comprising a pair of "new second" display elements, a pair of "new minute" display elements, and at least one hour display element, the least significant digit in the numerical display unit being one of the digits in the "new second" display elements, said circuit arrangement comprising first means for stepping the "new second" display elements every 0.36 seconds and for stepping the digits displayed by the "new second" display elements and the "new minute" display units to the scale of 100, said circuit arrangement also comprising second means for stepping the least significant digit in the numerical display unit at a rate corresponding to one step per one second, and means for selectively switching between the first and second means.

2. A digital time display system according to claim 1, wherein said stepping of said "new second" display elements every 0.36 seconds is visually distinguishable on said "new second" display elements.

* * * * *